United States Patent [19]

Kamata

[11] Patent Number: 4,821,344

[45] Date of Patent: Apr. 18, 1989

[54] HELMET

[75] Inventor: Eitaro Kamata, Tokyo, Japan

[73] Assignee: Shoei Kako Kabushiki Kaisha, Tokyo, Japan

[21] Appl. No.: 18,642

[22] Filed: Feb. 25, 1987

[30] Foreign Application Priority Data

Jan. 19, 1987 [JP] Japan ..... 62-5724[U]

[51] Int. Cl.[4] ..... A42B 3/02; A42C 5/04

[52] U.S. Cl. ..... 2/414; 2/181.6; 2/181.8

[58] Field of Search ..... 112/171.3, 171.4, 181.6, 112/181.8, 412, 413, 425, 437, 414

[56] References Cited

U.S. PATENT DOCUMENTS

| | | | |
|---|---|---|---|
| 1,602,727 | 10/1926 | Turner | 2/414 |
| 1,833,708 | 11/1931 | Ford | 2/413 |
| 3,946,441 | 5/1976 | Johnson | 2/412 |
| 4,081,865 | 4/1978 | Bergee | 2/425 |
| 4,434,514 | 3/1984 | Sundahl et al. | 2/181.6 |
| 4,627,115 | 12/1986 | Broersma | 2/414 X |
| 4,653,123 | 3/1987 | Broersma | 2/425 |
| 4,698,856 | 10/1987 | Arai | 2/425 |
| 4,700,411 | 10/1987 | Kawasaki et al. | 2/425 |
| 4,731,885 | 3/1988 | Nava | 2/171.3 X |

FOREIGN PATENT DOCUMENTS

| | | | |
|---|---|---|---|
| 566178 | 4/1933 | Fed. Rep. of Germany | 2/414 |
| 1578351 | 11/1980 | United Kingdom | 2/412 |

*Primary Examiner*—Wm. Carter Reynolds
*Attorney, Agent, or Firm*—Armstrong, Nikaido, Marmelstein & Kubovcik

[57] ABSTRACT

A helmet has a cap body is constituted by a shell. A buffer liner is mounted on an inner surface of the shell. A flexible top pad is disposed on a ceiling portion of an inner peripheral surface of the buffer liner, while a flexible fitted pad is disposed on the inner peripheral surface of the buffer liner excluding the ceiling portion. An air intake hole is made in a front wall of the cap body to penetrate the front wall. A through hole, which is connected to the air intake hole, is provided in the fitted pad. An inner opening of the through hole is covered with an air-permeable lining adhered to an inner surface of the fitted pad. A vertically extending elongated hole is provided in the fitted pad as the through hole, and a ventilation groove is provided in the top pad along an extension of the elongated hole.

8 Claims, 8 Drawing Sheets

HELMET

BACKGROUND OF THE INVENTION

1. Field of the Invention

The present invention relates to a helmet principally used by an operator of a motorcycle or racing car, and more particularly, to an improvement in a helmet in which a cap body is constituted of a shell and a buffer liner mounted on an inner surface of the shell. A flexible top pad is disposed on a ceiling portion of an inner peripheral surface of the buffer liner, while a flexible fitted pad is disposed on the inner peripheral surface of the buffer liner excluding the ceiling portion. An air intake hole is made in a front wall of the cap body to penetrate the front wall, so that travelling wind produced with travelling of a vehicle is introduced through the air intake hole into the cap body to provide ventilation within the body of the helmet.

2. Description of the Prior Art

There is conventionally known a helmet in which a very flexible continuously porous fitted pad is backed on a buffer liner, so that travelling wind drawn in an intake hole is dispersively supplied through pores in the fitted pad to the inside of the fitted pad (for example, see U.S. Pat. No. 4,054,953).

In general, however, the fitted pad has a relatively large thickness to permit the head of a user to conform to the inner surface of the cap body and hence, even if the fitted pad is continuously porous, it has a large resistance to air permeation. For this reason, with the above conventional helmet, only a very small amount of travelling wind reaches the inside of the fitted pad, and an improvement in ventilation is desired.

SUMMARY OF THE INVENTION

The present invention has been accomplished with such circumstances in view. It is an object of the present invention to provide a helmet of the type described above, which is simple in arrangement and very comfortable used, wherein a travelling wind drawn in an air intake hole can be reliably introduced to the inside of a fitted pad to provide good ventilation within the cap body.

To accomplish the above object, according to a first aspect of the present invention, there is provided a helmet in which a cap body is constituted of a shell and a buffer liner mounted on an inner surface of the shell. A flexible top pad is disposed on a ceiling portion of an inner peripheral surface of the buffer liner, while a flexible fitted bad is disposed on the inner peripheral surface of the buffer liner excluding the ceiling portion. An air intake hole is made in a front wall of the cap body to penetrate the front wall. A through hole communicating with the air intake hole is provided in the fitted pad. An inner opening of the through hole is covered with an air-permeable lining adhered to an inner surface of the fitted pad.

With such a construction, travelling wind drawn into the air intake hole can be reliably introduced into the inside of the fitted pad without disturbing the fitted pad. Moreover, the air can be dispersed to the inside of the cap body by the lining, thereby substantially improving ventilation within the cap body. The lining also functions as a filter for the introduced air and further serves to eliminate a dank feeling imparted to a user by the through hole.

In addition to the above construction, if the through hole is defined to have a shape different from that of the air intake hole with a sectional area equal to or larger than that of the air intake hole, so that the fitted pad covers a portion of an inner opening of the air intake hole, a peripheral edge of the inner opening of the air intake hole can be prevented from being brought into direct contact with the forehead of a user. The dank feeling imparted to the user by the air intake hole can be effectively moderated by utilizing the flexible fitted pad, without increasing a resistance of permeation to the air passed through the air intake hole as such air is entering the through hole in the fitted pad.

In addition, according to a second aspect of the present invention, there is provided a helmet in which a cap body is constituted of a shell and a buffer liner mounted on an inner surface of the shell. A flexible top pad is disposed on a ceiling portion of an inner peripheral surface of the buffer liner, while a flexible fitted pad is disposed on the inner peripheral surface of the buffer liner excluding the ceiling portion. An air intake hole is made in a front wall of the cap body to penetrate the front wall. A vertically extending elongated hole is provided in the fitted pad as a through hole connected to the air intake hole. A ventilation groove is provided in the top pad along an extension of the elongated hole.

With such a construction, wind leaving the through hole can be easily fed into the ventilation groove and can be smoothly passed through the top pad, so that ventilation within the cap body can be greatly enhanced.

In addition to the above construction, if the elongated hole is defined in a notched configuration with its upper end opened, the hole is in further close vicinity to the ventilation groove in the top pad, making it possible to promote introduction and discharge of air into and from the ventilation groove.

The above and other objects, features and advantages of the present invention will be apparent from the following detailed description of preferred embodiments taken in conjunction with the accompanying drawings.

BRIEF DESCRIPTION OF THE DRAWINGS

FIGS. 1 to 7 illustrate a first embodiment of the present invention, wherein FIG. 1 is a front view of a helmet;

FIG. 2 is a side view of the helmet;

FIG. 3 is a bottom view of the helmet;

FIG. 4 is a sectional view taken along a line IV—IV in FIG. 1;

FIG. 5 is a sectional view taken along a line V—V in FIG. 4;

FIG. 6 is a sectional view taken along a line VI—VI in FIG. 2; and

FIG. 7 is a view taken in a direction indicated by an arrow VII.

FIGS. 8 and 9 illustrate a second embodiment of the present invention, wherein FIG. 8 is a sectional view similar to FIG. 4; and FIG. 9 is a sectional view taken on line IX—IX in Figure.

DESCRIPTION OF PREFERRED EMBODIMENTS

Figure 1:
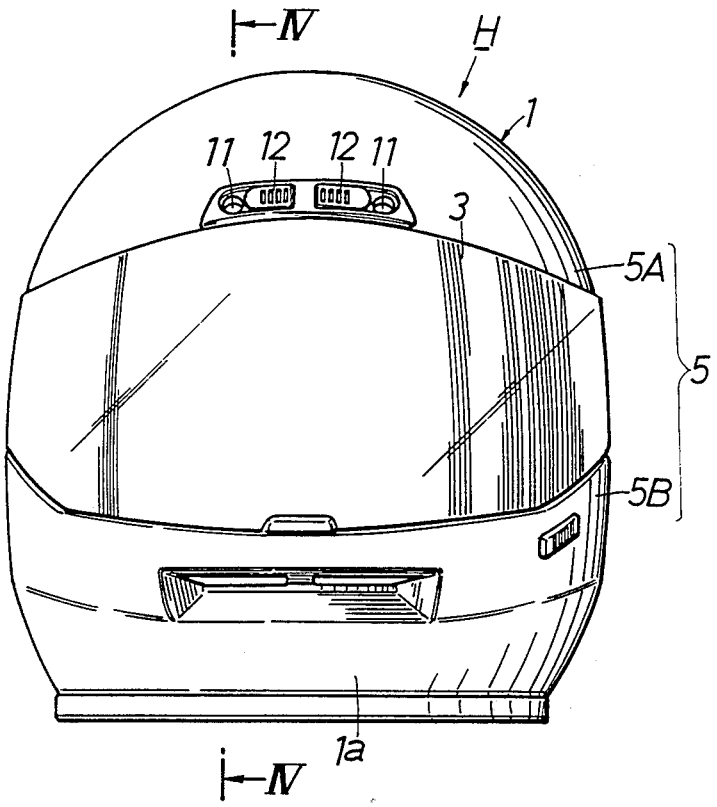

The present invention will now be described by way of embodiments with reference to the accompanying drawings.

Referring first to FIG. 1 to 5, a full-face helmet according to a first embodiment is shown and generally indicated by the reference character H, which is principally worn by an operator for motorcycle or a racing car. More specifically, the full-face helmet H includes a cap body 1 which has a chin cover portion 1*a* extending to form a lower edge of a window opening 2 in a front face. A light-pervious or transparent shield plate 3 is mounted at its opposite ends to the cap body 1 by means of pivots 4 in such a manner to open and close the window opening 2 through vertical pivotal movement of the shield plate 3.

The cap body 1 is comprised of a shell 5 and a buffer liner 6 made of a foamed polystyrene and mounted on the inner surface of the shell 5.

The shell 5 is divided into an upper shell portion 5A and a lower shell portion 5B at a place of the chin cover portion 1*a*. Both the portions 5A and 5B are partially overlaid with the lower shell portion 5B located outside and being interconnected at several points in the overlaid area by means of rivets 7. The upper shell portion 5A is molded from a thermosetting synthetic resin such as a fiber-reinforced polyester, and the lower shell portion 5B is made by injection molding from a thermoplastic synthetic resin such as ABC. If the shell 5 is divided into upper and lower portions in the above manner, the lower portion of the shell 5 can be easily fabricated even with a shape having a lower opening narrowed.

A top pad 8 made of a soft urethane foam is adhesively bonded to a ceiling portion of the inner peripheral surface of a buffer liner 6. A fitted pad 9 similarly made of a soft urethane foam is overlaid on the inner peripheral portion of the buffer liner 6 excluding the ceiling portion. A lining 10 which is very air-permeable such as a pile backing (or pile lining) is sewed to the inner surface of the fitted pad 9 with its outer end clamped between the shell 5 and the buffer liner 6.

A front wall of the cap body 1 is perforated with a pair of left and right air intake holes 11 penetrating the shell 5 and the buffer liner 6 just above the window opening 2. Slide lids 12 are mounted on the shell 5 for opening and closing inlet ports of the holes 11. The fitted pad 9 is also perforated with a pair of front through holes 13 at places corresponding to the air intake holes 11. The air intake hole 11 and the through hole 13 have sectional configurations different from each other (see FIG. 5), and in this embodiment, the air intake hole 11 is circular, while the front through hole 13 is oval to vertically extend with a width approximately half the diameter of the air intake hole 11. Moreover, the sectional area of the front through hole 13 is set at a value equal to or larger than that of the air intake hole 11. The inner opened end of the front through hole 13 is covered with the lining 10.

Two ventilation grooves 14 are defined in the form of recesses in the inner surface of the top pad 8 along backward extensions of the front through holes 13, i.e., the elongated holes.

Further, a pair of air discharge holes 15 are made in the opposite rear side walls of the cap body 1 to pass through the shell 5 and the buffer liner 6. Rear through holes 16 are made in the fit pad 9 at places aligned with the air discharge holes 15. The air discharge hole 15 and the rear through hole 16 are defined in the same relationship as between the air intake hole 11 and the front through hole 13, as shown in FIGS. 6 and 7.

Figure 2:
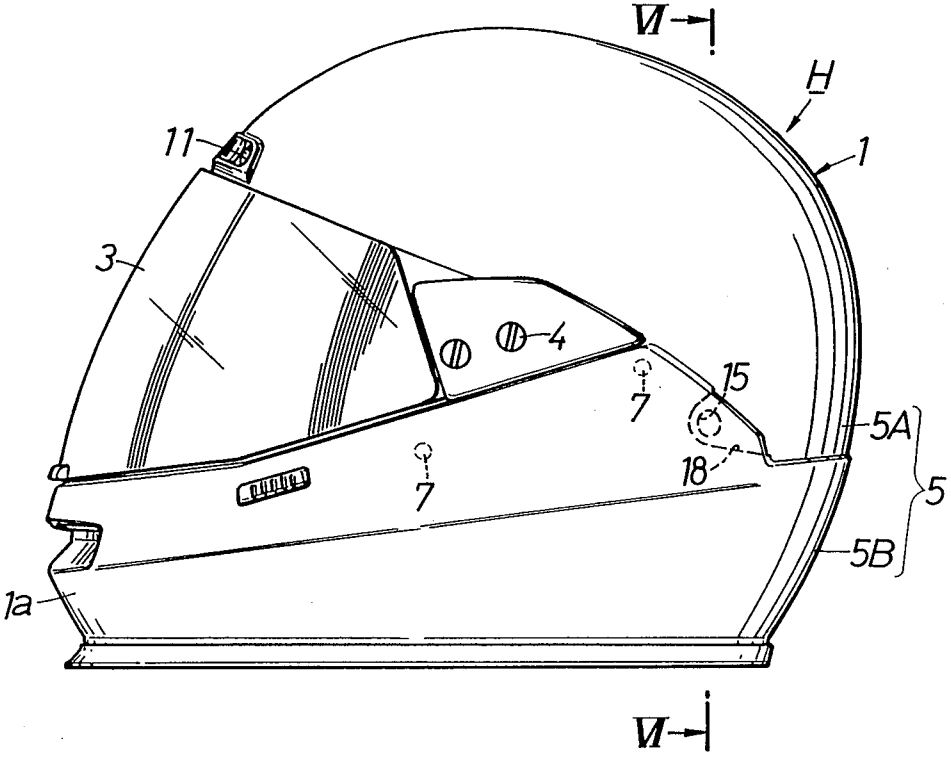
Figure 3:
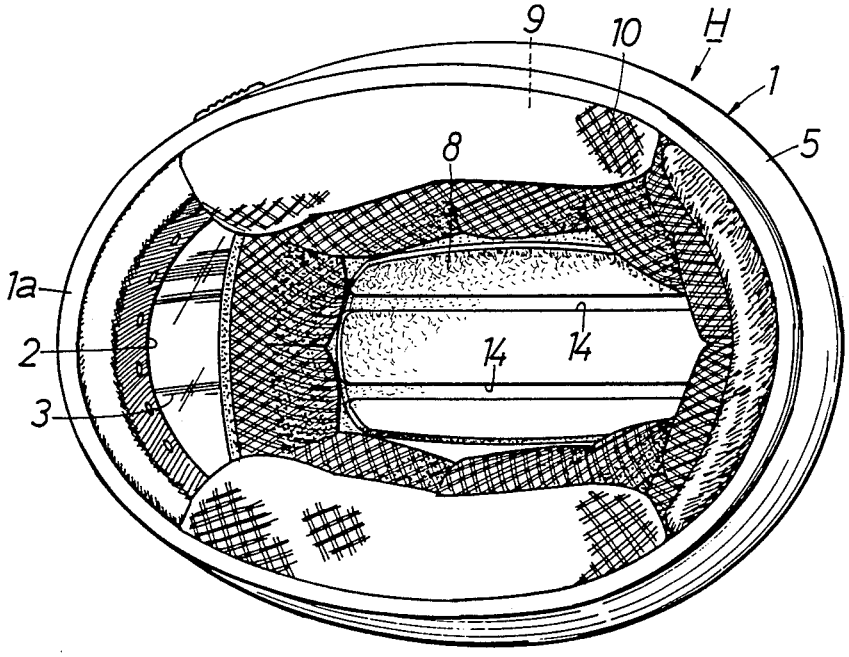
Figure 6:
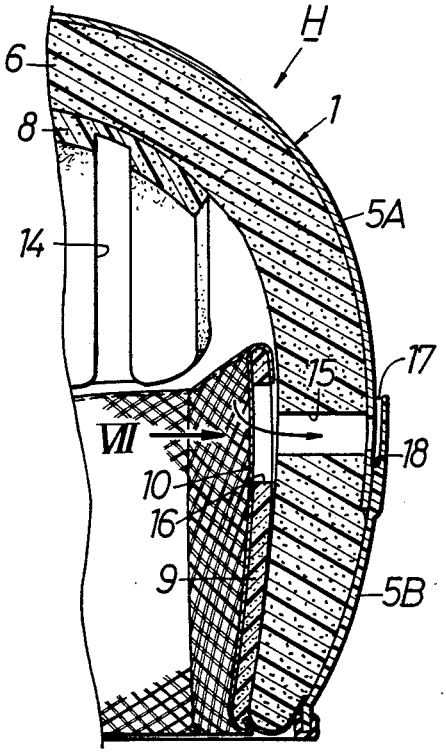
Figure 7:
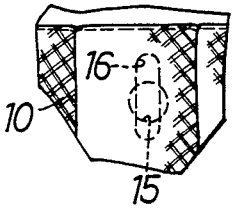

Each of the air discharge holes 15 is opened at its outer end to the outer surface of the upper shell portion 5A, and the lower shell portion 5B is formed to cover an opened end, with a vent gap 17 being left therebetween, as shown in FIGS. 2 and 6, thereby preventing entry of rain into the discharge hole 15. The vent gap 17 is opened upwardly and rearwardly and closed at its lower end by a step or shoulder 18 of the lower shell portion 5B. The step or shoulder 18 is inclined rearwardly downwardly to facilitate the discharge of rain entering the vent gap 17.

Figure 4:
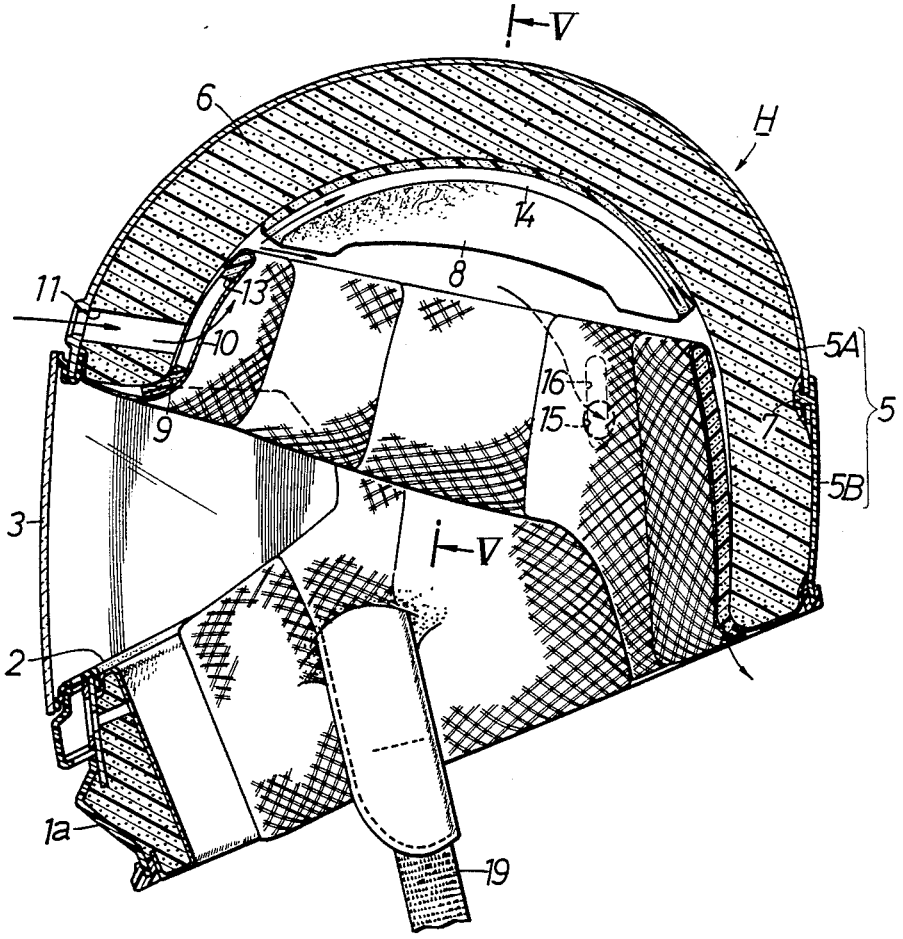
Figure 5:
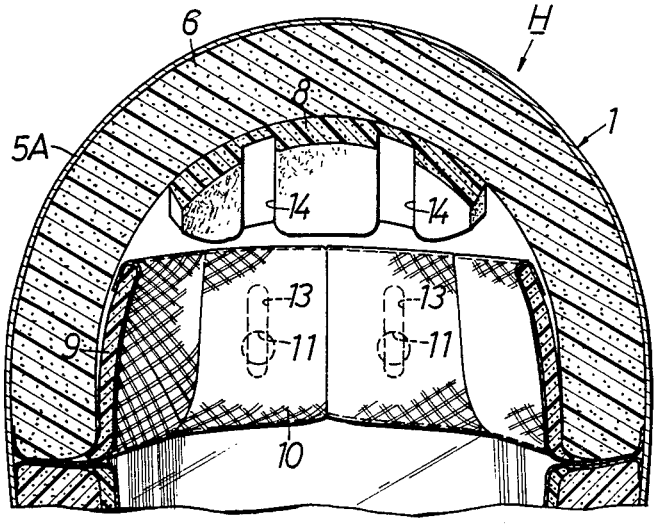

In FIG. 4, reference numeral 19 designates a chin belt secured to the inner surface of the upper shell portion 5A by means of rivets which are not shown.

Description will now be made of the operation of this embodiment.

If an operator wearing the helmet H of the present invention leaves the slide lid 12 opened, for example, during operation of a motorcycle, travelling wind enters the air intake hole 11 in the cap body 1 and passes through the front through hole 13 in the fitted pad 9 to permeate the air permeable lining 10 while being dispersed by the lining 10. Then, the air flows upwardly along the forehead of the operator and then rearwardly along the ventilation groove 14 in the top pad 8, and permeates the lining 10 again. Then, the air passes through the rear through hole 16 and the air discharge hole 15 and is discharged rearwardly of the cap body 1. In this manner, the interior of the cap body 1 is ventilated Since the front through hole 13 is defined in the form of an elongated hole longer in the vertical direction, and the ventilation groove 14 is provided in the top pad 8 on an extension of such elongated hole, the flow of air from the front through hole 13 into the ventilation groove 14 is relatively smooth, and the ventilation of the interior of the cap body 1 is promoted.

In addition, negative pressure is being generated at the outer opening of the air discharge hole 15 by the flow of travelling wind along the outer side surface of the cap body 1 and therefore, discharging of air through the air discharge hole 15 is satisfactorily conducted. This also promotes the ventilation.

Further, as the travelling wind permeates the lining 10 after passing through the front through hole 13, it is filtered by the lining 10 serving as a filter, so that the forehead of the operator opposed to the front through hole 13 may be prevented from being fouled with dust.

Still further, since the air intake hole 11 and the front through hole 13 as well as the air discharge hole 15 and the rear through hole 16 have different shapes, respectively and partially overlaid one on another, a portion of the opened edge of the air intake hole 11 is covered with the very flexible fitted pad 9 and hence, it is possible to moderate a dank feeling imparted to the forehead of the operator by the air intake hole 11. Additionally, since the front and rear through holes 13 and 16 are covered with the lining 10, a dank feeling somewhat imparted to the forehead of the operator by these through holes 13 and 16 can be prevented by the lining 10. In this way, it is possible to provide a very comfortable helmet H.

Moreover, since the front through hole 13 has a sectional area equal to or larger than that of the air intake hole 11, a resistance of ventilation cannot be increased.

Figure 9:
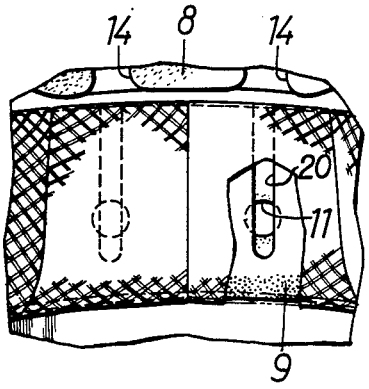
Figure 8:
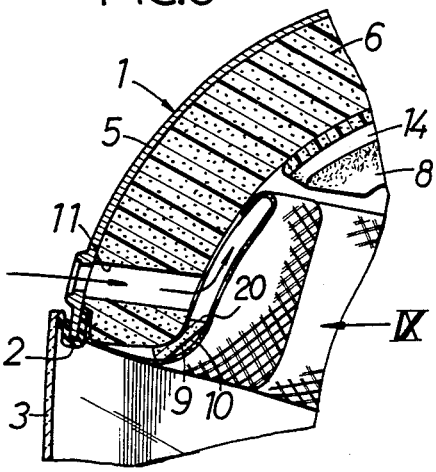

FIGS. 8 and 9 illustrate a second embodiment of the present invention, wherein a construction is similar to that in the previous embodiment, except that each of front and rear through holes 20 and 16 in the fitted pad 9 (only the front through hole 20 is shown in Figures) is defined in the form of a notched, elongated hole having one end opened toward the ventilation groove 14 in the top pad 8. In FIGS. 8 and 9 portions corresponding to those in the previous embodiment are denoted by the same reference characters as in the previous embodiment.

With the second embodiment, the front and rear through holes 20 and 16 are located in further close vicinity to the ventilation groove 14 in the top pad 8, thereby making it possible to promote introduction and discharging of air into and from the ventilation groove 14.

Figure 10:
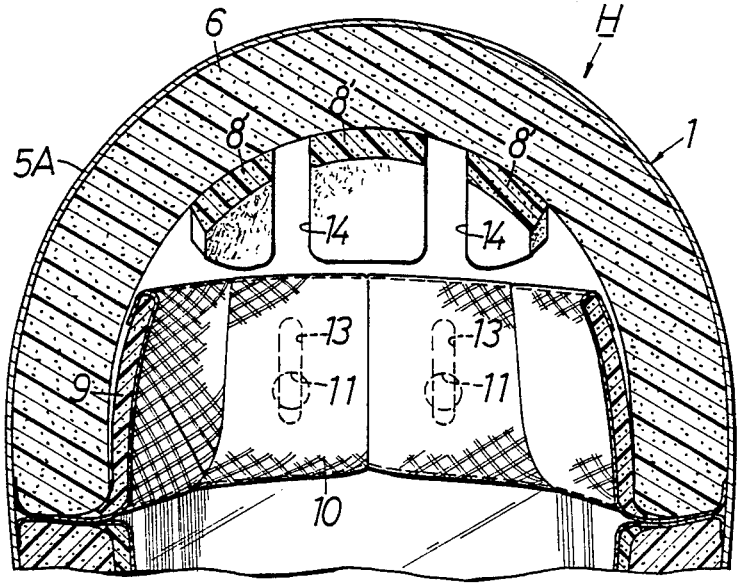
FIG. 10 is a sectional view similar to FIG. 5, showing a modification of the first embodiment.

Alternatively, in defining a ventilation groove 14, the top pad 8 may be divided into a plurality of pieces which may be adhesively bonded to the buffer liner 6 at distances spaced apart from one another to define the ventilation groove 14, for example, as shown in FIG. 10.

What is claimed is:

1. A helmet comprising:

a cap body, said cap body including a shell and a buffer liner mounted on an inner surface of said shell, a flexible top pad being disposed on a ceiling portion of an inner peripheral surface of said buffer liner, a flexible fitted pad being disposed on the inner peripheral surface of said buffer liner excluding said ceiling portion, and an air intake hole being made in a front wall of said cap body to penetrate the front wall, wherein a vertically extending elongated hole being provided in the fitted pad as a through hole communicated to said air intake hole, and a ventilation groove being provided in said top pad along an extension of said elongated hole.

2. A helmet according to claim 1, wherein an air permeable lining covers an inner opening of said vertically extending elongated hole, said air-permeable lining being a pile lining.

3. A helmet according to claim 1, wherein a plurality of each of said air intake holes, said elongated holes and said ventilation grooves are provided, respectively.

4. A helmet according to claim 1, wherein said elongated hole is defined in a notched configuration with an upper end opened.

5. A helmet according to claim 1, wherein said through hole is defined to have a shape different from that of said air intake hole and a sectional area equal to or larger than that of said air intake hole, so that said fitted pad covers a portion of an inner opening of said air intake hole.

6. A helmet according to claim 1, wherein said ventilation groove is defined as a recessed groove in a surface of the single top pad.

7. A helmet according to claim 1, wherein said cap body is provided with a slide lid for opening and closing an inlet of said air intake hole.

8. A helmet comprising: a cap body, said cap body including a shell and a buffer liner mounted on an inner surface of said shell, a flexible top pad being disposed on a ceiling portion of an inner peripheral surface of said buffer liner, a flexible fitted pad being disposed on the inner peripheral surface of said buffer liner excluding said ceiling portion, and an air intake hole being made in a front wall of said cap body to penetrate the front wall, wherein a vertically extending elongated hole being provided in the fitted pad as a through hole communicated to said air intake hole, and a ventilation groove being provided along an extension of said elongated hole and defined by having said top pad being a plurality of pieces and adhesively bonding said pieces onto said buffer liner at a distance spaced apart from each other.

* * * * *